US006311449B1

(12) United States Patent
Morse et al.

(10) Patent No.: US 6,311,449 B1
(45) Date of Patent: Nov. 6, 2001

(54) SECURING DECKS TO HOUSES WITH "L"-SHAPED BRACKETS

(76) Inventors: Michael G. Morse, 1000 Gold Mine Rd., Brookeville, MD (US) 20833; Daniel P. Walsh, 17332 LaFayette Dr., Olney, MD (US) 20832

( * ) Notice: Subject to any disclaimer, the term of this patent is extended or adjusted under 35 U.S.C. 154(b) by 0 days.

(21) Appl. No.: 09/368,924

(22) Filed: Aug. 6, 1999

(51) Int. Cl.[7] ..... E04B 1/38

(52) U.S. Cl. ..... 52/702; 52/289; 52/236.9; 52/741.1

(58) Field of Search ..... 52/289, 712, 655.1, 52/741.1, 79.6, 702, 299, 264, 236.9; 248/220.1, 220.21

(56) References Cited

U.S. PATENT DOCUMENTS

| | | | | |
|---|---|---|---|---|
| H1795 | * | 7/1999 | Leek | 52/712 |
| 2,104,874 | * | 1/1938 | Levy | 52/263 |
| 2,321,221 | * | 6/1943 | Linehan | 403/230 |
| 3,837,135 | * | 9/1974 | Zachman | 52/702 |
| 3,966,056 | * | 6/1976 | Larson | 211/134 |
| 4,014,089 | * | 3/1977 | Sato et al. | 29/525.11 |
| 4,074,947 | * | 2/1978 | Matake et al. | 403/231 |
| 4,347,015 | * | 8/1982 | Olashaw | 403/219 |
| 4,825,621 | * | 5/1989 | Jensen | 52/702 |
| 5,058,358 | * | 10/1991 | Stratton | 52/702 |
| 5,109,646 | * | 5/1992 | Colonias et al. | 52/712 |
| 5,364,312 | * | 11/1994 | Cunard et al. | 472/118 |
| 5,467,570 | * | 11/1995 | Leek | 52/712 |
| 6,073,405 | * | 6/2000 | Kasai et al. | 52/283 |
| 6,088,982 | * | 7/2000 | Hiesberger | 52/241 |

* cited by examiner

*Primary Examiner*—Gregory J. Strimbu
(74) *Attorney, Agent, or Firm*—Richard L Huff

(57) ABSTRACT

"L"-shaped brackets for connecting floor joists of houses to a structural band board and deck ledger board so that the deck ledger board will be supported by the weight-bearing floor joists of the houses. The brackets are "L"-shaped, having one short leg, one long leg, and at least one triangular brace connecting the legs. Each leg contains a plurality of holes for the passage of through bolts. The short legs abut the band board and the through bolts pass through the short legs of the brackets, the band board, and the ledger board. The long legs abut the weight-bearing joists and the through bolts pass through the long leg of one of the backet, one of the weight-bearing joists, and the long leg of one of the brackets on the opposing side of the weight-bearing joist.

13 Claims, 9 Drawing Sheets

SECURING DECKS TO HOUSES WITH "L"-SHAPED BRACKETS

BACKGROUND OF THE INVENTION

1. Field of the Invention

This invention is directed to a device for securing decks to houses. The device is an "L"-shaped body having a short leg, a long leg, a plurality of bolt holes in each leg and at least one triangular brace supporting the legs. By the use of this device, deck ledger beams may be firmly attached to band boards and floor joists of houses to prevent the collapse of decks.

2. Description of the Related Art

It is the current practice to attach deck ledger beams to the band boards of houses when constructing decks in new or existing houses. The flaw in this procedure is that band boards were never intended to be weight-bearing parts. Therefore, when a deck become stressed by having a large number of people on it or because of strong winds, the band boards of the house pull away from the house structure and the deck collapses. As decks become more popular, this potential for property damage and injury to the occupants and guests occupying the decks becomes more common. To the inventors' knowledge, there are no known devices for attaching the band board of a house to the joists of a house so as to make the band board a structural weight-bearing part of the house.

The prior art is aware of various brackets for attaching structural pieces of wood, concrete, or steel.

U.S. Pat. No. 2,321,221 to Linehan discloses a bracket for connecting a joist to the foundation of a structure. This bracket is prepared from a single sheet bent in such a way as to form a "L"-shaped body having, a short leg, a long leg, and a triangular brace along one side of the body. Because of the way this bracket is manufactured, the short leg will always contain an overlapping of two layers of the sheet. It would be impossible for the brace to be located along the center line of the bracket or for the bracket to have a pair of side braces. Also, because of the method of manufacture, it would be impossible for the brace to extend only part of the way along the short leg of the bracket.

U.S. Pat. No. 4,148,164 to Humphrey discloses a support which will aid in the attachment of a fascia board to the rafters of a roof of a house. This support has an "L"-shaped section which attaches to a rafter and an "L"-shaped section which connects to a fascia board. This support is constructed from a single piece of metal and has the capacity to be so angled as to fit against the sloped rafter and the vertical fascia board. This support is so constructed that the panel of the section fitting against the rafter will abut with the panel of the section fitting against the fascia board, and these two panels can be held in position by nails going into the rafter. No "L"-shaped bracket is disclosed by this patent, and no brace between the two legs of an "L"-shaped bracket is disclosed.

U.S. Pat. No. 4,825,621 to Jensen discloses a holddown useful for attaching a vertical stud to a horizontal concrete floor. This holddown contains a two-layered bottom section containing a single hole, a multi-angled back section, and two multi-angled side sections which extend to the outer edge of the bottom section. Due to the fact that the back and the bottom of the disclosed holddown fail to form a 90° angle at their juncture, the use of the holddown for securing band boards and ledger boards to joist beams would be difficult.

U.S. Pat. No. 5,467,570 to Leek discloses a tension tie for securing structural members to each other. The device is made of a single piece and contains an "L"-shaped body comprising a long leg, a short leg and two triangular side members. The short leg must contain four layers and a single hole. The side members extend to the edge of the short leg.

U.S. Pat. No. 5,666,781 to Egawa et al discloses in Example 3 a metal fastener containing copper cladding for attaching wooden structural pieces. The fastener is an "L"-shaped piece containing a long leg, a short leg, and a triangular piece going from the end of the short leg to the side of the long leg. The triangular piece must be along the edge as it serves as a support for a structural piece. The long leg does not abut against any structural piece.

SUMMARY OF THE INVENTION

The purpose of this invention is to provide for the first time, a way of securing decks to houses in a way that the weight of the deck falls on the structural support of the house. This is done by bolting the ledger boards of the deck to the band boards and floor joists of the house by means of a unique bracket, thus making the band boards a weight-bearing part of the house.

The bracket comprises an "L"-shaped body which has a short leg, a long leg, a plurality of holes in each leg and at least one triangular support piece which terminates at or near the ends of the legs. The short leg of the bracket is firmly attached to a band board of the house and a ledger board of a deck by through bolts and the long leg of the bracket is attached to the end of a joist next to a band board, thus securing the band board and the ledger board to the supporting structure of the house. Preferably, a bracket is placed on each side of a joist for added strength, through bolts passing through the joist and both brackets.

DESCRIPTION OF THE PREFERRED EMBODIMENTS

Figure 1:
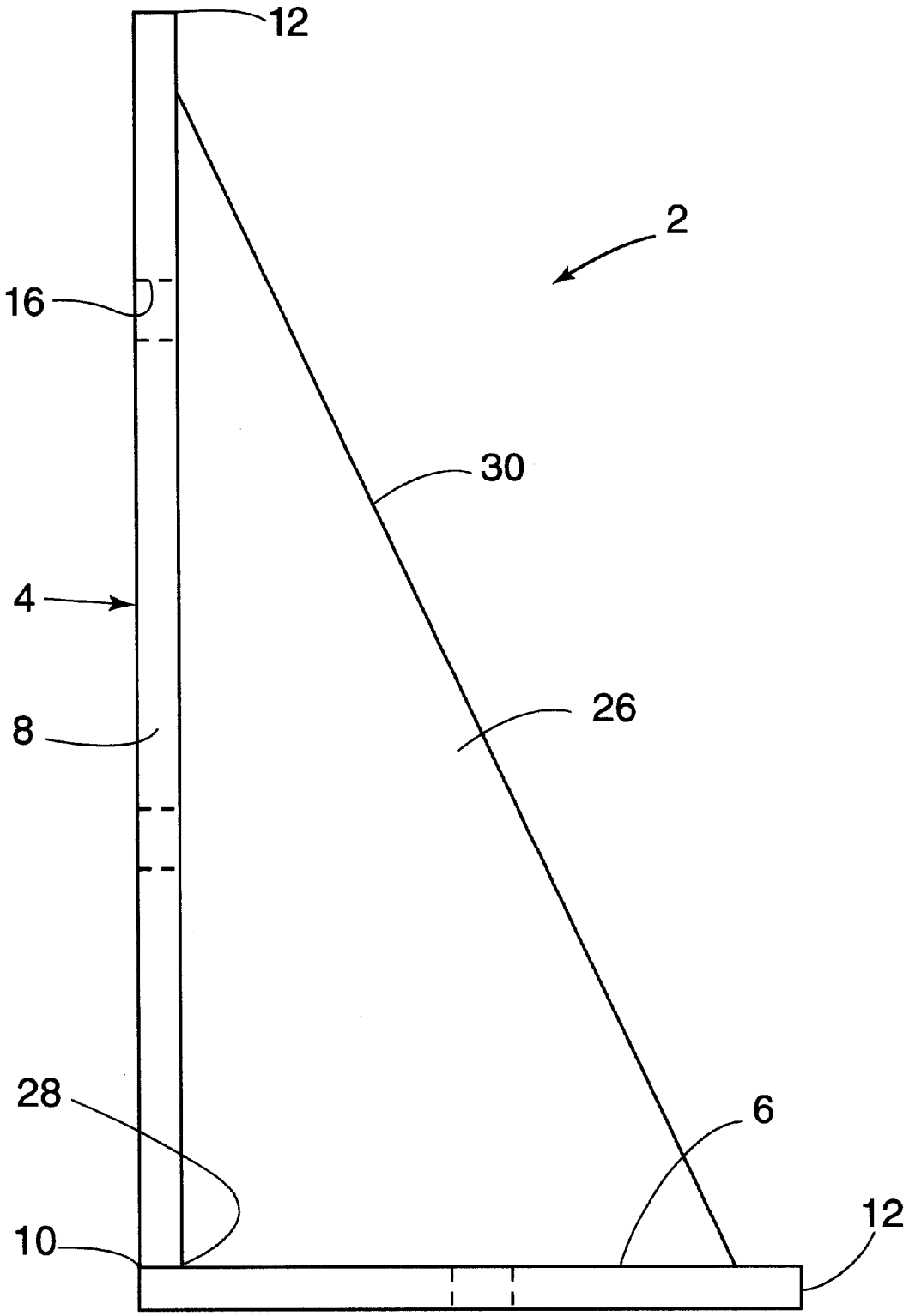
FIG. 1 is a side view of a bracket of the first embodiment of this invention.
Figure 2:
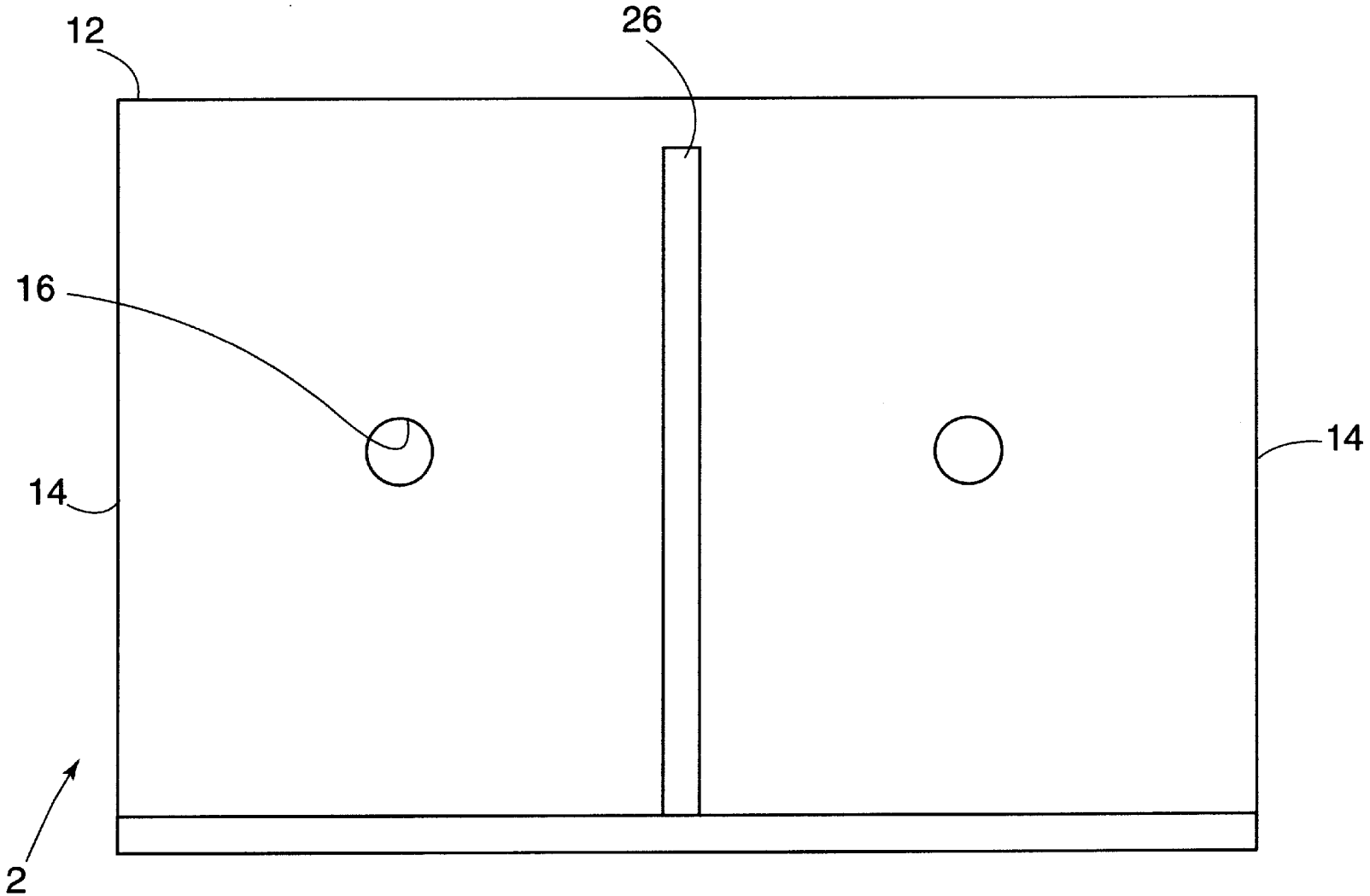
FIG. 2 is a top view of a bracket of the first embodiment of this invention.
Figure 3:
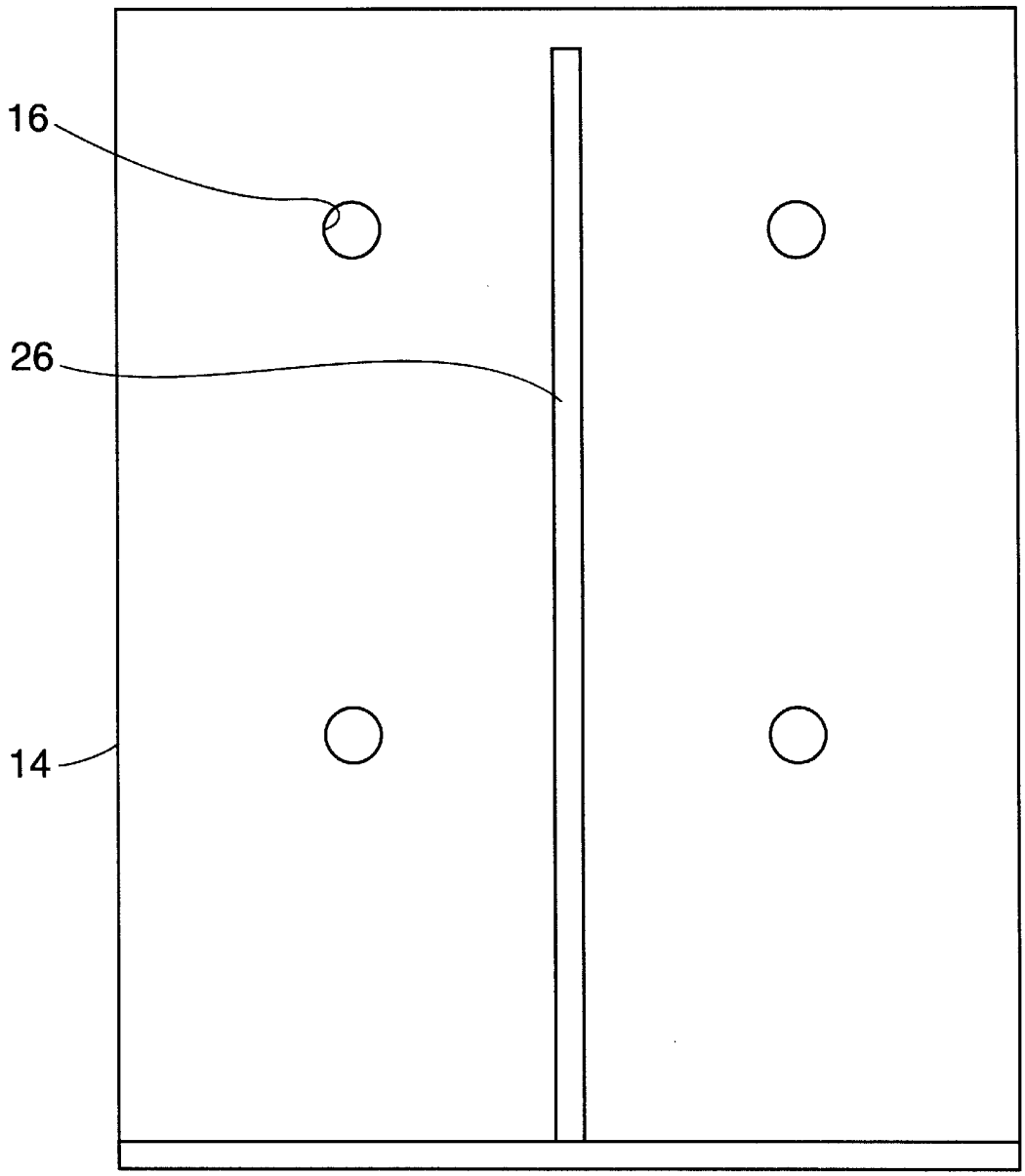
FIG. 3 is a front view of a bracket of the first embodiment of this invention.
Figure 4:
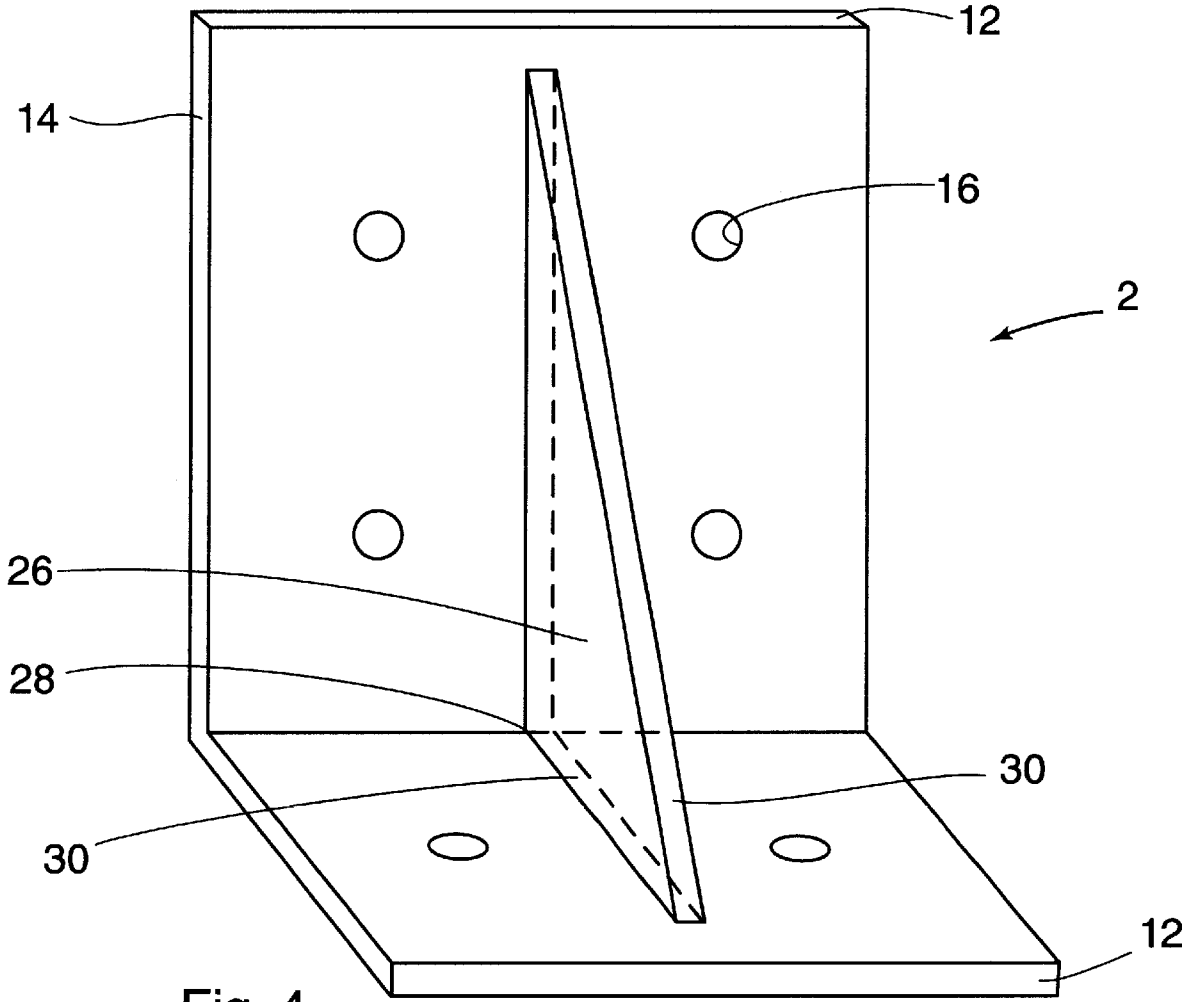
FIG. 4 is a perspective view of a bracket of the first embodiment of this invention.
Figure 5:
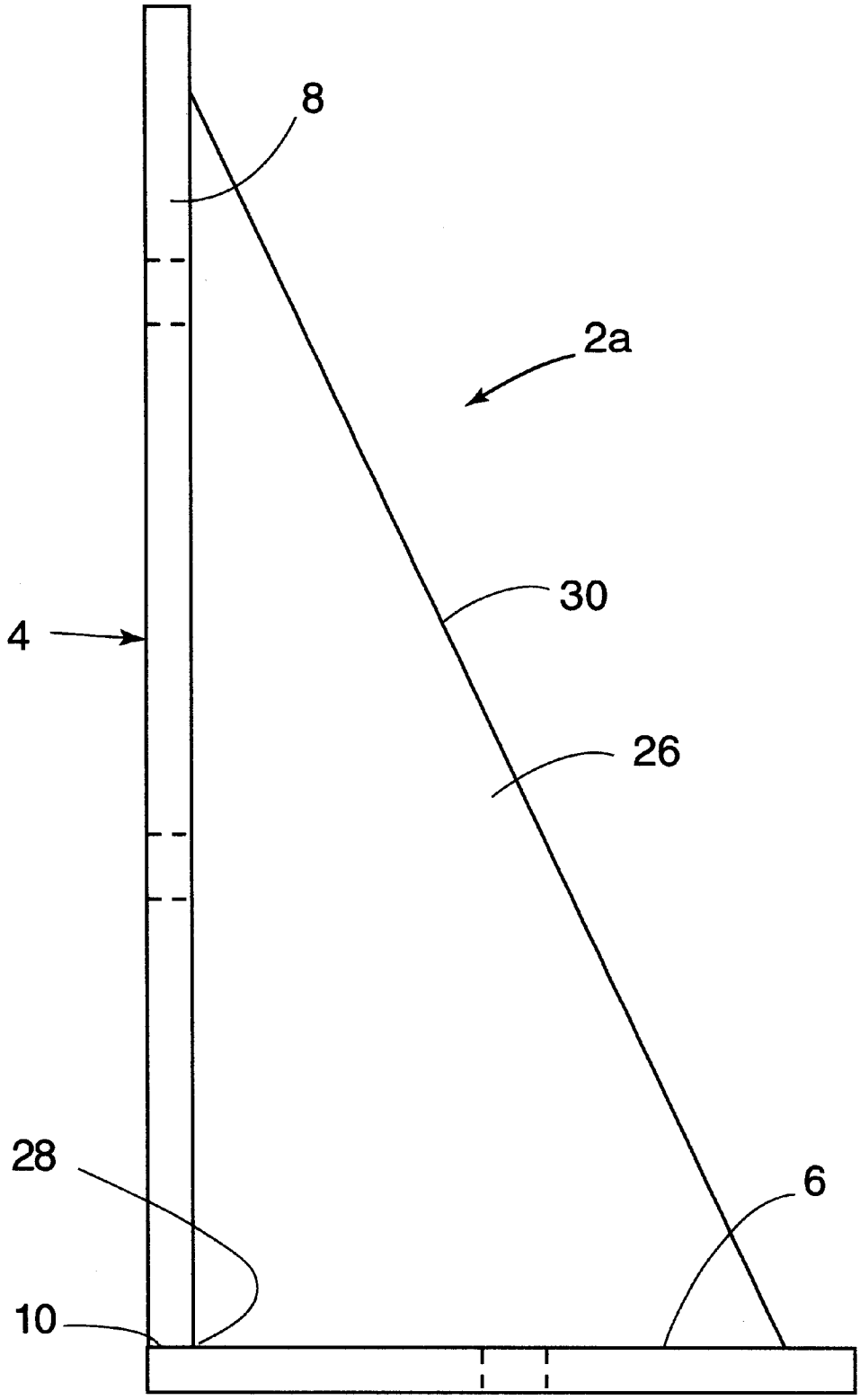
FIG. 5 is a side view of a bracket of the second embodiment of this invention.
Figure 6:
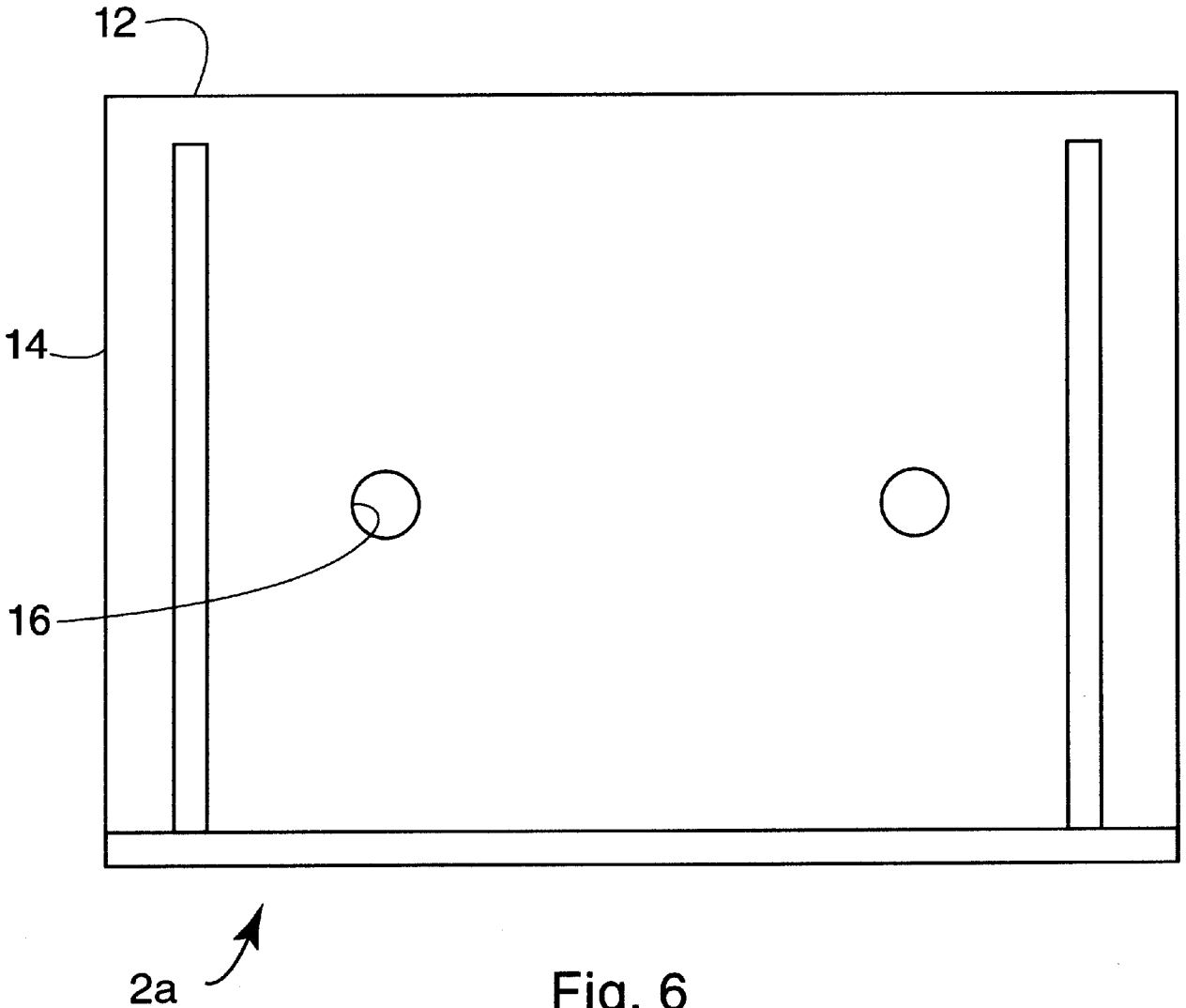
FIG. 6 is a top view of a bracket of the second embodiment of this invention.
Figure 7:
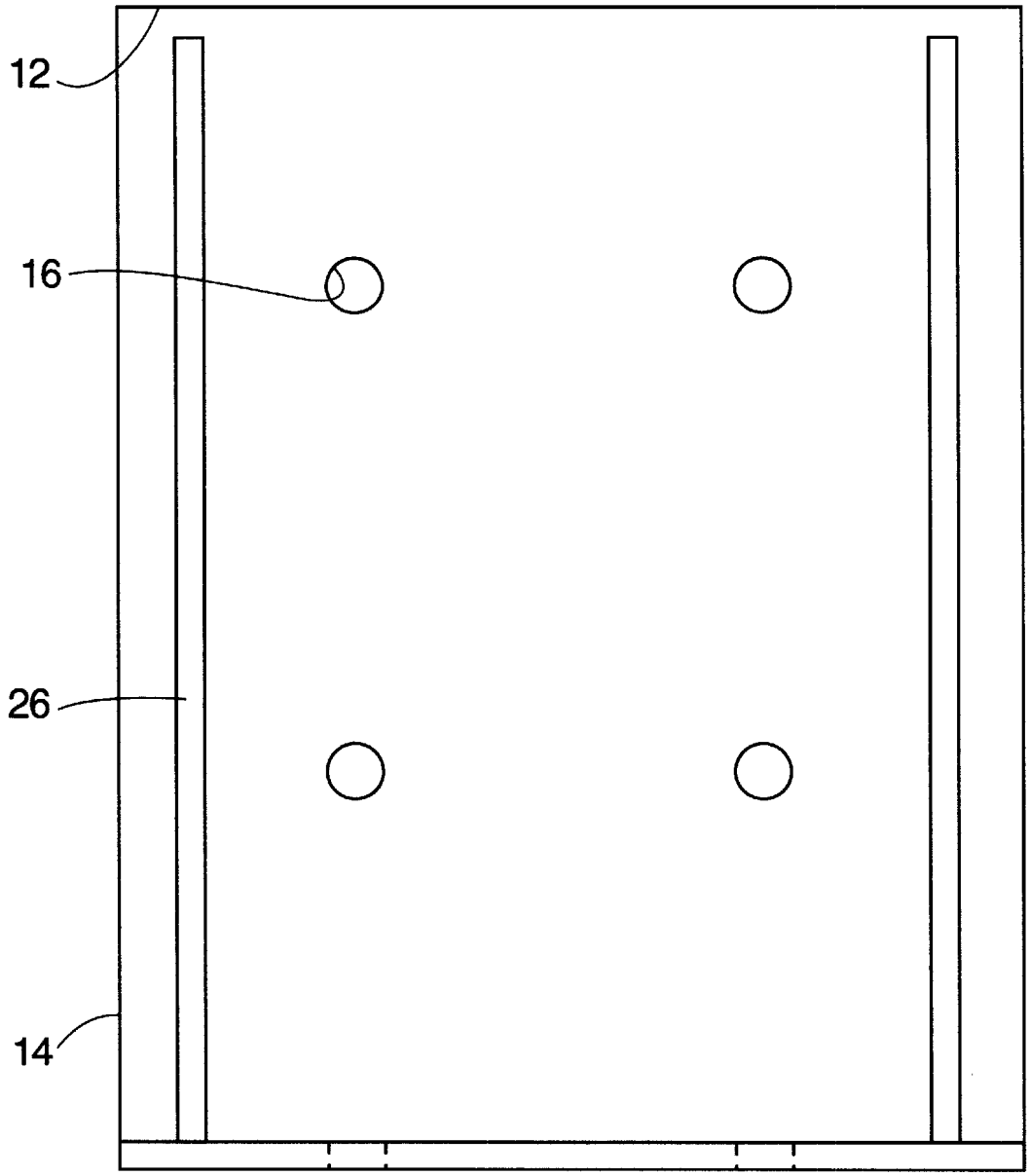
FIG. 7 is a front view of a bracket of the second embodiment of this invention.
Figure 8:
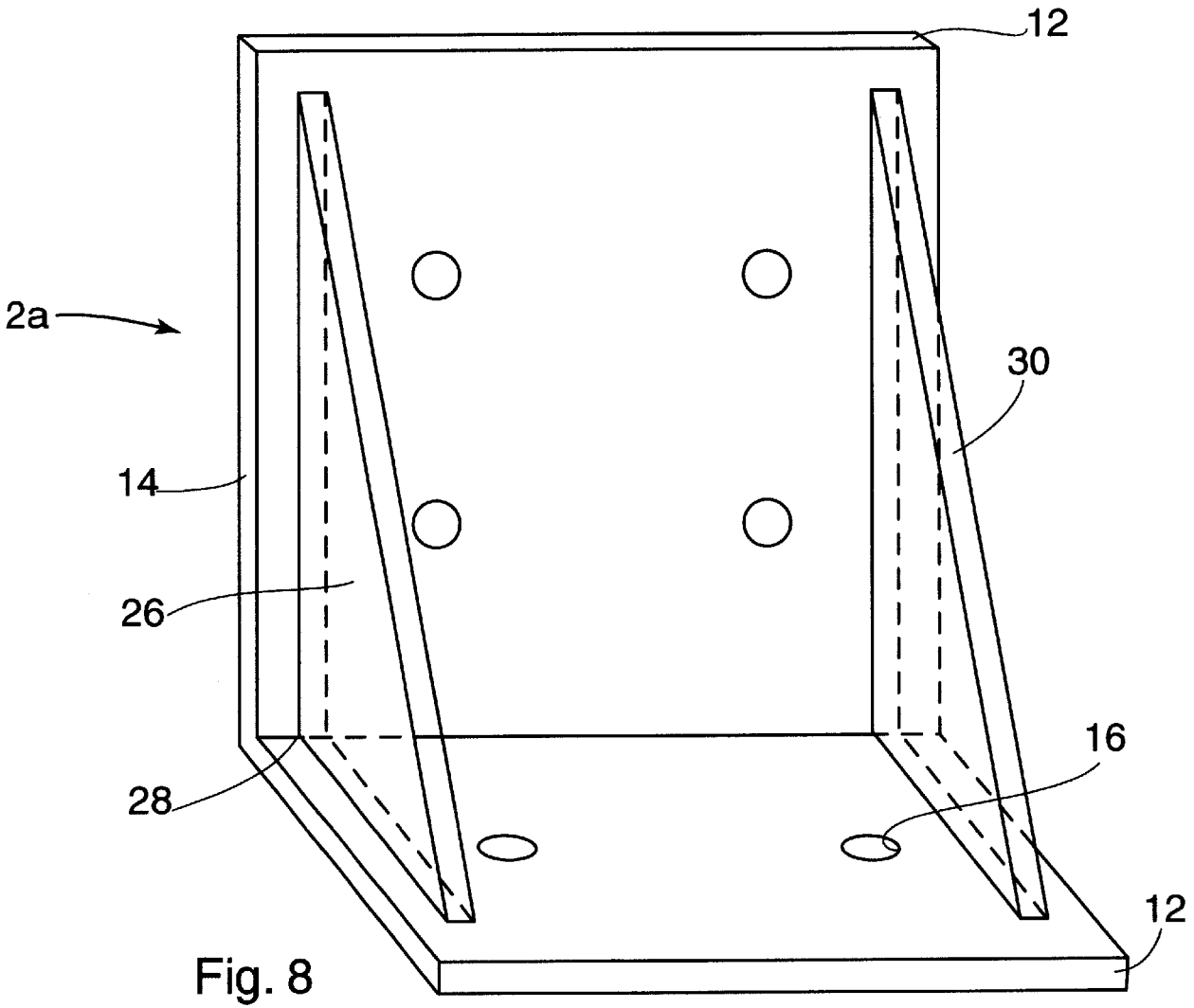
FIG. 8 is a perspective view of a bracket of the second embodiment of this invention.
Figure 9:
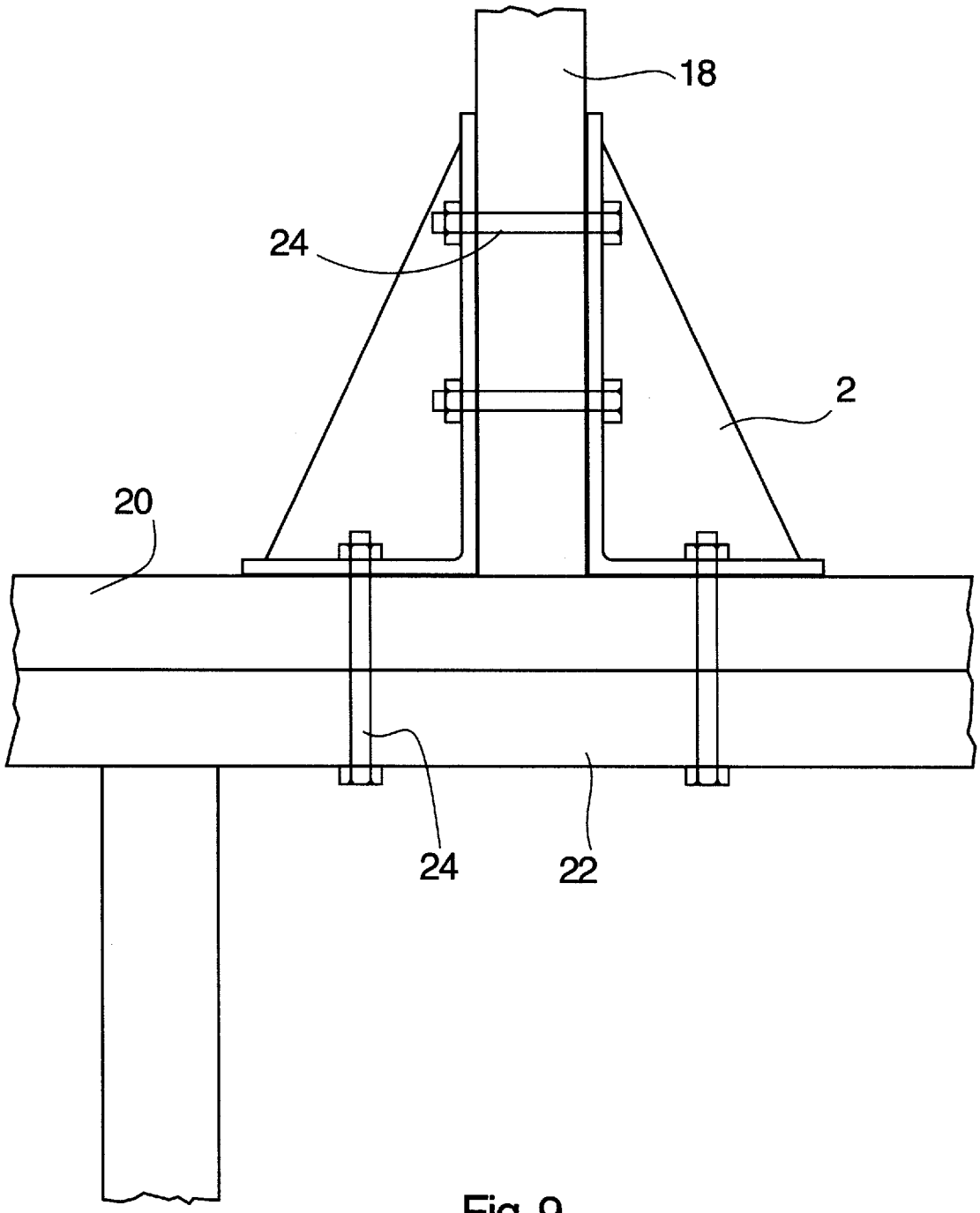
FIG. 9 is a top view of a bracket of the present invention in combination with a joist beam, a band board, a ledger board, and a ledger beam.

The invention will now be described with reference to the above drawings, like numerals referring to like features throughout.

There are two preferred embodiments of the bracket of the present invention.

In the first preferred embodiment, the bracket 2 comprises an "L"-shaped body 4 comprising a short leg 6, a perpendicular long leg 8, and a juncture 10 of the short leg 6 and the long leg 8. Each leg 6, 8 of the bracket 2 has one free end 12, two side edges 14, and a central line running from one end 12 to the other end 12 equidistant between the two side edges 14. Each leg 6, 8 contains a plurality of holes 16 for connection of the bracket 2 to the joist 18, band board 20 and ledger board 22, preferably by means of through bolts 24. A solid triangular brace 26 is located along the central line of the bracket 2. The brace 26 has an apex 28 at the juncture 10 of the two legs 6, 8 and a base 30 running from one leg 6 to the other 8 and terminating at or near the ends 12 of the legs 6, 8. Preferably, the brace 26 terminals are at points which are at a distance from the ends 12 of the legs 6, 8.

The second preferred embodiment is similar to the first, but contains a plurality, preferably two, solid triangular braces 26 instead of one. These braces 26 lie along or near the side edges 14 of the bracket 2*a*, preferably between the center line and the edges 14.

The long leg 8 of a bracket or 2*a* is firmly attached, preferably by through bolts 24, to a side of a joist 18 at a point where the joist 18 connects with a band board 20 of a house. It is preferred that at least half of the joists 18 have two brackets or 2*a*, one for each side. In such instances, the through bolts 24 pass through corresponding holes 16 in the brackets or 2*a*. The short leg 6 is firmly attached by through bolts 24, to a band board 20 of the house and a ledger board 22 of a deck, thus securing the ledger board 22 to the band board 20 and the band board 20 to the joists 18 and making the band board 20 a weight-bearing structural member of the house. Accordingly, weight on the deck is transferred through the ledger beams 32 of the deck to the ledger boards 22 of the deck to the band boards 20 of a house and then to the joists 18 of the house. The combination of the present invention is operable whether the joists 18, band boards 20, ledger boards 22, or ledger beams 32 are made of wood or metal. Preferably, these structural elements are made of wood. In the combination of this invention, the joists 18 contain one or two brackets or 2*a*, preferable two (one on each side) for increased strength. In securing these structural elements, a plurality of the brackets or 2*a* of this invention are secured to a plurality of joists 18 by through bolts 24 running through a bracket or 2*a*, through a joist 18, and through the bracket or 2*a* on the opposing side of the joist 18 and are secured to both the band boards 20 and the ledger boards 22 by through bolts 24 running through the brackets or 2*a*, through the band boards 20, and through the ledger boards 22. The ledger beams 32 may then be secured to the ledger boards 22 and be supported by the structural support of the building. This is a vast improvement compared to the present situation wherein weight on the deck is transferred to only the band board of the house, which was never intended to bear weight.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A combination of i) a building comprising joist beams, and band boards, ii) a building addition comprising ledger boards and ledger beams, and iii) a plurality of brackets secured to a plurality of said joist beams by bolts running through a respective pair of the brackets and through a respective one pair of the joist beams, the brackets also being secured to both the band boards and the ledger boards by bolts running through the brackets, through the band boards, and through the ledger boards.

2. The combination of claim 1 wherein the brackets each comprise an "L"-shaped body comprising a short leg, a perpendicular long leg, and a juncture of the short leg and the long leg, each of said brackets having two ends, two side edges, and a central line running from one of said ends to the other one of said ends equidistant between the two side edges, and each leg containing a plurality of holes running therethrough; each of said brackets further comprising a solid triangular brace located along the central line of the bracket, and having an apex at the juncture of the two legs and a base running from one of said legs to the other one of said legs and terminating adjacent the ends of the bracket.

3. The combination of claim 1 wherein the brackets comprise an "L"-shaped body comprising a short leg, a perpendicular long leg, and a juncture of the short leg and the long leg, each of said brackets having two ends, two side edges, and each leg containing a plurality of holes running therethrough; each of said brackets further comprising a pair of solid triangular braces each adjacent a respective one of to the side edges of the bracket, and having an apex at the juncture of the two legs and a base running from one of the legs to the other one of the legs and terminating adjacent the ends of the bracket.

4. The combination of claim 1, wherein the building is a house and the building addition is a deck.

5. The combination of claim 1, wherein at least one of the joist beams, band boards, and ledger boards is made of wood.

6. The combination of claim 1, wherein at least one of the joist beams, band boards, and ledger boards is made of metal.

7. The combination of claim 1, wherein at least a majority of the joist beams which have one of said brackets secured thereto have one of said brackets on each side thereof.

8. A method of securing a building addition comprising ledger boards and ledger beams to a building comprising joist beams and band boards, which method comprises securing a plurality of brackets to a plurality of said joist beams by bolts running through a respective pair of the brackets and through a respective one of the joist beams and securing the plurality of brackets to both the band boards and the ledger boards by bolts running through the brackets, through the band boards, and through the ledger boards.

9. The method of claim 8 wherein the brackets each comprise an "L"-shaped body comprising a short leg, a perpendicular long leg, and a juncture of the short leg and the long leg, each of said brackets having two ends, two side edges, and a central line running from one of said ends to the other one of said ends equidistant between the two side edges, and each leg containing a plurality of holes running therethrough; each of said brackets further comprising a solid triangular brace located along the central line of the bracket, and having an apex at the juncture of the two legs and a base running from one of said legs to the other one of said legs and terminating adjacent the ends of the bracket.

10. The method of claim 8 wherein the brackets each comprise an "L"-shaped body comprising a short leg, a perpendicular long leg, and a juncture of the short leg and the long leg, each of said brackets having two ends, two side edges, and each leg containing a plurality of holes running therethrough; each of said brackets further comprising a pair of solid triangular braces each adjacent a respective one of to the side edges of the bracket, and having an apex at the juncture of the two legs and a base running from one of the legs to the other one of the legs and terminating adjacent the ends of the bracket.

11. The method of claim 8, wherein the building is a house and the building addition is a deck.

12. The method of claim 8, wherein at least one of the joist beams, band boards, and ledger boards is made of wood.

13. The method of claim 8, wherein at least a majority of the joist beams which have one of said brackets secured thereto have one of said brackets on each side thereof.

* * * * *